United States Patent [19]

Imanishi

[11] 4,012,937

[45] Mar. 22, 1977

[54] WORK TRANSFER AND DRIVE DEVICE IN A TRANSFER PRESS

[75] Inventor: Shozo Imanishi, Sagamihara, Japan

[73] Assignee: Aida Engineering Ltd., Kanagawa, Japan

[22] Filed: Mar. 23, 1976

[21] Appl. No.: 669,650

[30] Foreign Application Priority Data

Apr. 5, 1975 Japan ..... 50-40789

[52] U.S. Cl. ..... 72/419; 72/421

[51] Int. Cl.[2] ..... B21D 43/00

[58] Field of Search ..... 72/405, 419, 421

[56] References Cited

UNITED STATES PATENTS

| | | | |
|---|---|---|---|
| 3,011,464 | 12/1961 | Danly | 72/405 |
| 3,105,399 | 10/1963 | Strugala | 72/405 |
| 3,434,328 | 3/1969 | Taniguchi | 72/405 |
| 3,805,582 | 4/1974 | Logan | 72/405 |
| 3,937,056 | 2/1976 | Henzler | 72/405 |

FOREIGN PATENTS OR APPLICATIONS

| | | | |
|---|---|---|---|
| 291,869 | 10/1953 | Switzerland | 72/405 |

*Primary Examiner*—C.W. Lanham
*Assistant Examiner*—Gene P. Crosby

[57] ABSTRACT

A work transfer and drive device in a transfer press is disclosed having a stationary shaft supported in the framework of said press and an actuator gear rotatably mounted on said shaft to be driven by the drive means of said press. A sun gear is mounted on said shaft in coaxial relationship to said actuator gear, a planetary gear is secured to an eccentric shaft on said actuator gear in meshing with said sun gear, and a first eccentric pin integral with said eccentric shaft is slidably received in a radial groove formed in a rotary member rotatably mounted on said stationary shaft. A second eccentric pin in said rotary member is operatively connected to a first slidable member to be guided by a stationary guide bar parallel to feed bars and a second slidable member is operatively connected to said first slidable member and one of feed bars.

3 Claims, 8 Drawing Figures

Y
X
20
15
10
5
0
-5
-10
-15
-20
50
55
60
65
70
75
80
P102
P70
P78
M
175
k1
k2
B60
B63
B66
B69
B72
B75
B78
B81
B84
B87
B90
B93
B96
B99
B102
B105
B108
B111
B114
B117
B120
β = 4.266°

WORK TRANSFER AND DRIVE DEVICE IN A TRANSFER PRESS

BACKGROUND OF THE INVENTION

This invention relates to a transfer press and more particularly, to a device for positively providing the advance and return movements of the feed bars in the successive increment feed of a work through various operation stations in the transfer press.

Hithereto, as schematically shown in FIG. 1, the conventional transfer press incrementally feeds a work through various operation stations in the press by repeatedly advancing and returning a pair of feed bars 17, 17' each having a plurality of clampers 17*a*, 17'*a*, respectively and the timing diagram with respect to varying crank angles in the rotation of the crank in the transfer drive press is as shown in FIG. 2 in which the movement of the feed bars is interrupted after the bars have advanced a work by the angular distance of 120° from the crank angle of 300° through the upper dead point of 0° to the crank angle 60° in the rotation of the crank, the work is unclamped from the feed bars for the next angular distance of 60° in the crank rotation, the work is then processed, the feed bars are moved in the return stroke for the next angular distance of 120° in the crank rotation, the feed bars are stopped again and the work is clamped by the feed bars for the next angular distance of 60° in the crank rotation. As the device for driving the feed bars in the advance and return strokes in the transfer press, the following devices have been proposed and practically employed, that is, (a) a pneumatic or oil cylinder-type drive device, (b) a cam and lever-type drive device, (c) a chain-driven drive device, (d) a rack and pinion-type drive device and (e) a planetary gear mechanism. However, the convention feed bar drive devices referred to hereinabove have their respectively inherent advantages and disadvantages with respect to performance, cost and versatility and in consequence, the conventional feed bar drive devices were not perfectly satisfactory.

SUMMARY OF THE INVENTION

Therefore, the object of the present invention is to provide a work transfer and drive device which can effectively eliminate the disadvantages of the conventional work transfer and drive devices, which operates in perfect synchronization with the operation of the press which assures a rest time interval corresponding to the angular distance of 60° of the crank rotation for unclamping and clamping of a work by the feed bar clampers, which exhibits excellent operation performance, which ensures smooth advance and return stroke movements of the feed bars in the transfer press and which can be produced at relatively less expense.

The above and other objects and attendant advantages of the present invention will be more readily apparent to those skilled in the art from a reading of the following detailed description in conjunction with the accompanying drawings which show one preferred embodiment of the invention for illustration purpose only, but not for limiting the scope of the same in any way.

BRIEF DESCRIPTION OF THE DRAWINGS

FIG. 4 is a sectional view taken substantially along the line D — D of FIG. 3 showing the feed bars in their substantially stationary position at the dead end of the advance stroke for the angular distance of 60°–120° in the rotation of the crank;

PREFERRED EMBODIMENT OF THE INVENTION

Figure 1:
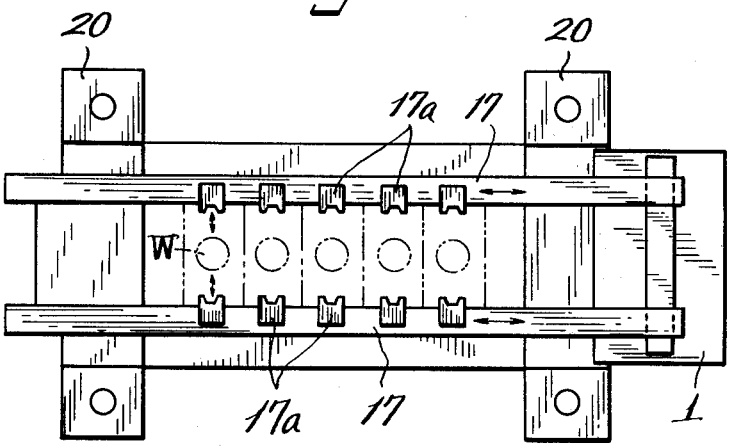
FIG. 1 is a fragmentary top plan view of essential parts of a transfer press in which the work transfer and drive device of the invention is utilized.
Figure 2:
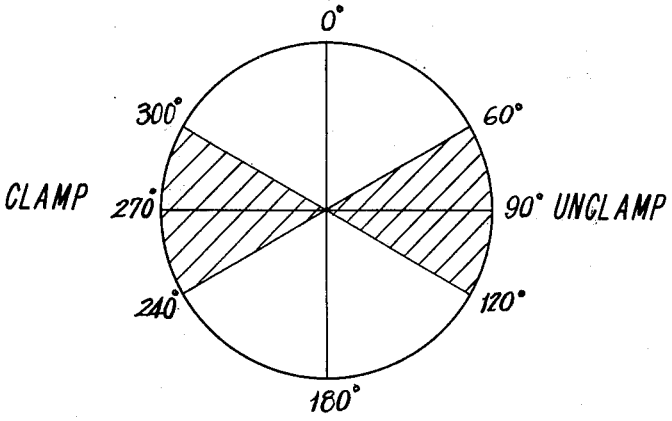
FIG. 2 is a diagrammatic view showing the general work transfer timing in said transfer press.

The present invention will be now described referring to the accompanying drawings and more particularly, to FIG.1 thereof in which essential parts of a transfer press in which the work transfer and drive device of the invention is utilized. In FIG. 1, reference 20 denotes a pair of columns of a press, references 17, 17' denote a pair of feed bars each including a plurality of clampers 17*a*, 17'*a*, respectively reference 1 denotes the casing of a feed bar drive unit and reference W denotes a work.

Figure 3:
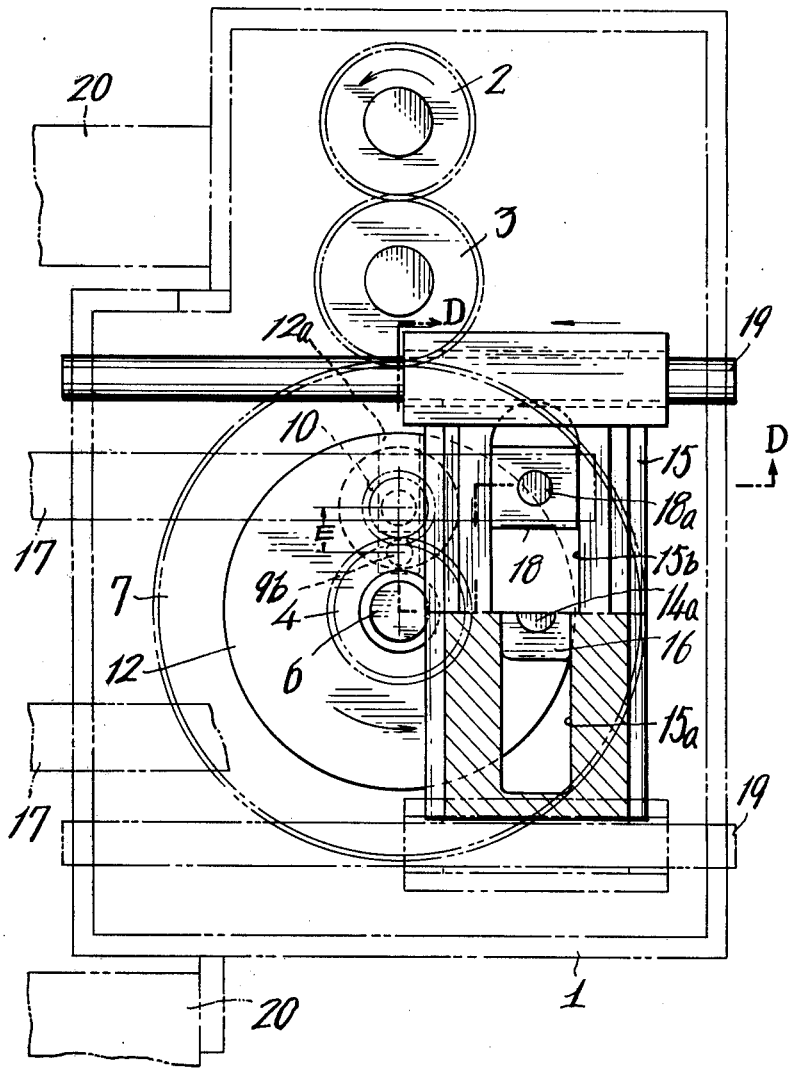
FIG. 3 is a top plan of one preferred embodiment of work transfer and drive device constructed in accordance with the present invention.
Figure 2:
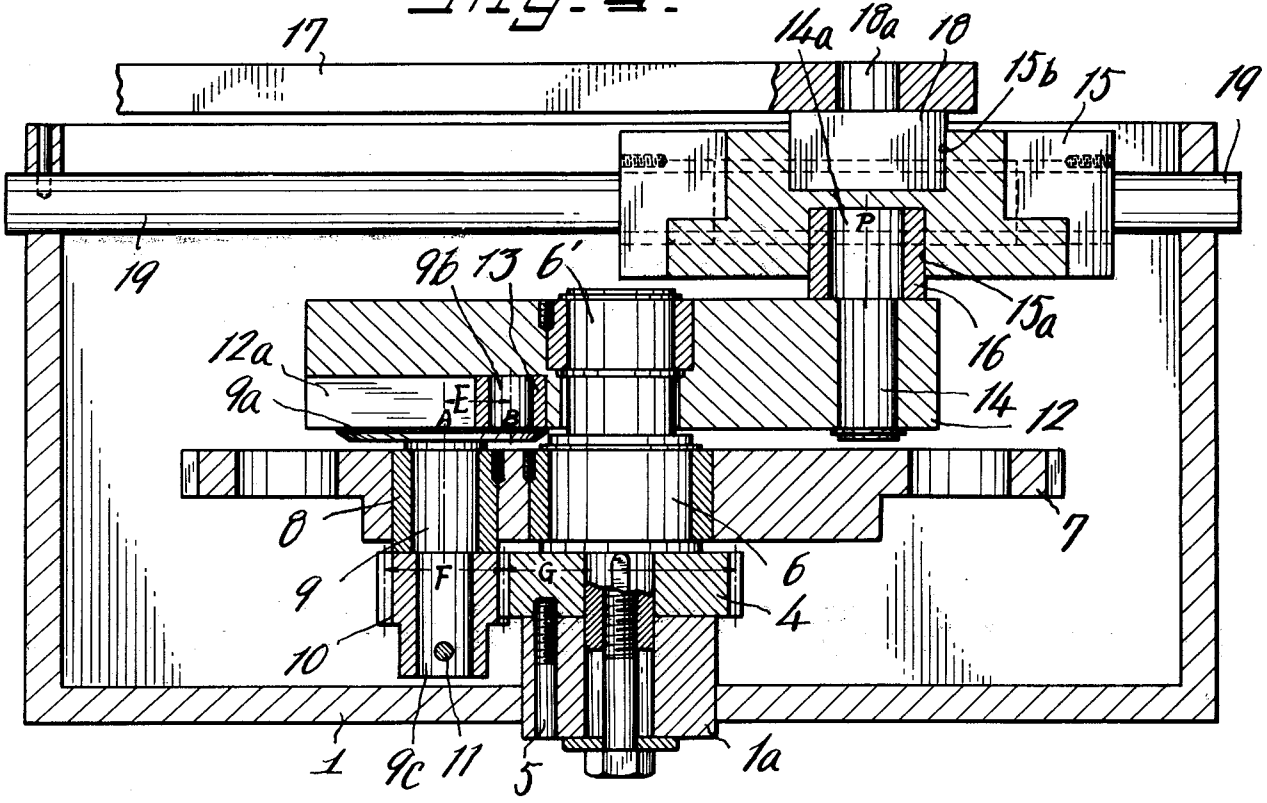

FIG. 3 and 4 show one preferred embodiment of work transfer and drive device of the invention. As shown in these Figures, a stationary shaft 6 is fixedly secured to the boss 1*a* of the casing 1 of the feed bar drive unit and an actuator gear 7 is freely mounted on the stationary shaft 6. A sun gear 4 is mounted on the stationary shaft 6 and secured to the boss 1*a* by means of bolts 5 in coaxial relationship to the actuator gear 7. A drive gear 2 to be driven by an intermediary shaft of the press (not shown) meshes with an idle gear 3 which in turn meshes with the actuator gear 7. An eccentric shaft 9 is rotatably supported in the actuator gear 7 with a bush 8 interposed therebetween in an eccentrical relationship to the gear 7 and secured to the eccentric shaft 9 by means of a pin 11 is a planetary gear 10 which in turn meshes with the sun gear 4. An eccentric pin 9*b* is provided at the end of the eccentric shaft 9 remote from the planetary gear 10 and a roller 13 is loosely mounted on the eccentric pin 9*b* and slidably received in a radial grove 12*a* formed in a disc 12 which is freely and rotatably mounted on the extension 6' of the stationary shaft 6. An eccentric pin 14 is provided in the disc 12 and has the head 14*a* loosely fitted in a slider 16 which is slidably fitted in an elongated groove 15*a* formed in a slider 15 at right angles to the feed bars 17 associated with the slider 15. The slider 15 has another elongated groove 15*b* in which another slider 18 is slidably received and the slider 18 has a pin 18*a* loosely fitted in the feed bar 17. The slider 15 is guided by a guide bar 19 secured to the casing 1.

In the construction referred to hereinabove, the base circle diameter G of the sun gear 4, the base circle diameter F of the planetary gear 10 and the eccentricity distance E of the eccentric pin 9b with respect to the planetary gear 10 has the ratio of 120 : 60 : 39.

The operation of the work transfer and drive device of the present invention will be now described. FIG. 3 is a top plan view showing the device in the position corresponding to the press crank angle of 90° and in this Figure, the feed bars 17 are shown in the stationary position at the feed end of the feed stroke at the press crank angle of 60° and FIG. 4 is a sectional view taken substantially along the line D — D of FIG. 3.

When the drive gear 2 is transmitted a drive force from the prime mover (not shown) through the intermediary shaft (not shown) in the press and rotates in the counterclockwise direction as seen in FIG. 3, the drive gear rotates the actuator gear 7 in the same direction through the idle gear 3 which meshes with both the drive gear and actuator gear. The rotation of the actuator gear 7 causes the planetary gear 10 on the eccentric shaft 9 to revolve about the sun gear 4 which meshes with the planetary gear and the eccentric pin 9b on the eccentric shaft 9 of the actuator gear 7 rotates the disc 12 in the counterclockwise direction with the roller 13 on the eccentric pin 9b sliding within the radial groove 12a in the rotary disc 12 whereby the eccentric pin 14 in the disc 12 moves the slider 15 in the return direction (from right to left as seen in FIG. 4) with the slider 16 on the eccentric pin 14 sliding within the groove 15a in the slider 15.

Figure 5:
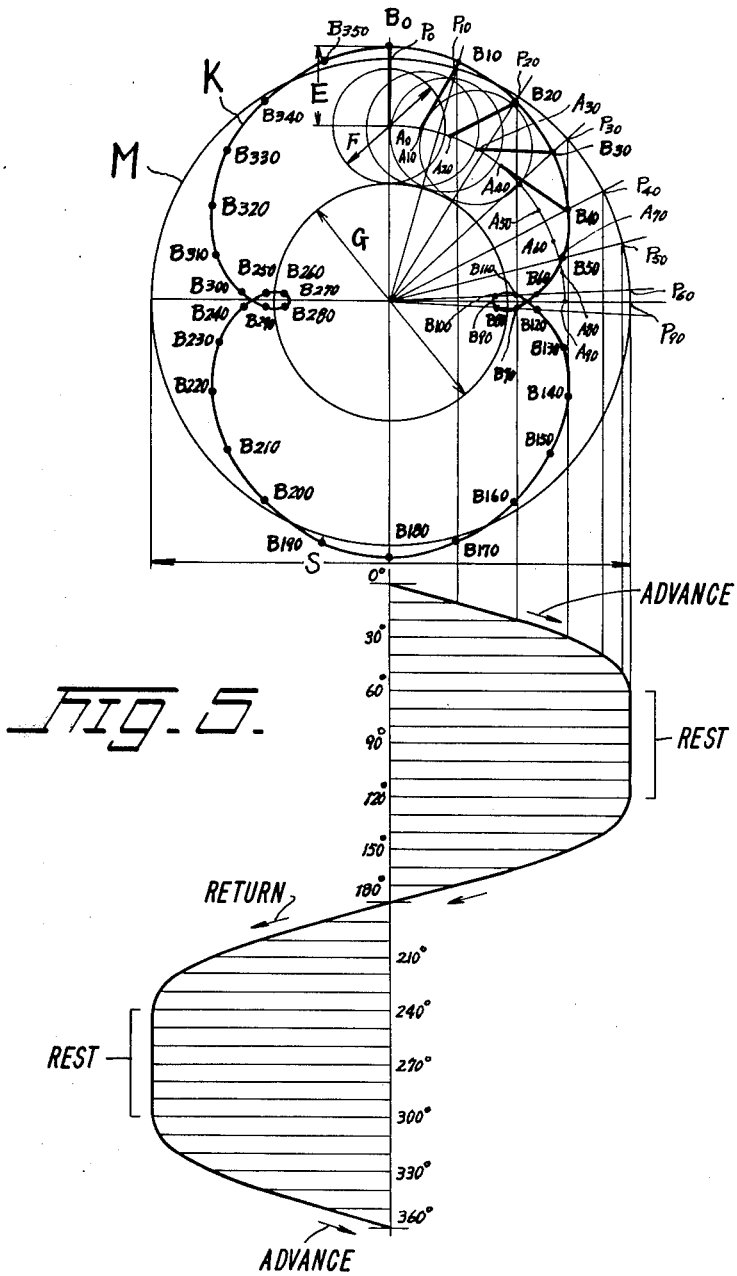
FIG. 5 is a view of the curve showing the movement loci of the eccentric pins 9*b* and 14*b* shown in FIG. 3 with respect to varying press crank angles and also the curve showing the feed bars in their various positions in the movement of the bars.
Figure 6:
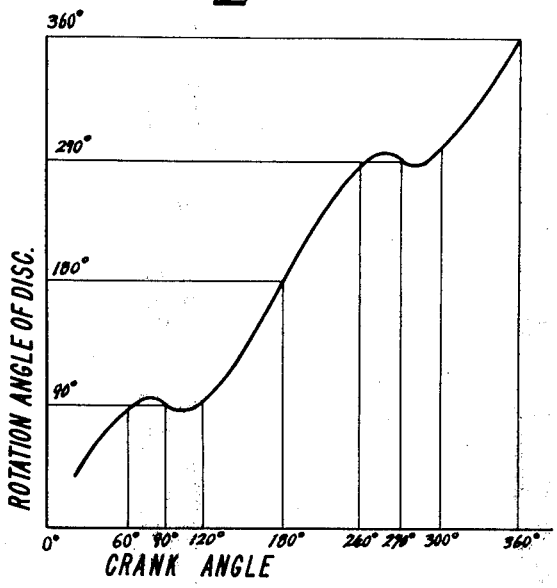
FIG. 6 is an explanative curve showing the rotation angle variation of the disc with respect to varying press crank angles.
Figure 7:
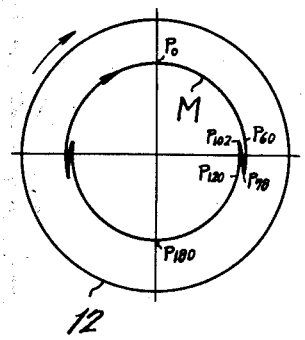
FIG. 7 is a simple explanative view showing the fine increment rotation mode of the disc.
Figure 8:
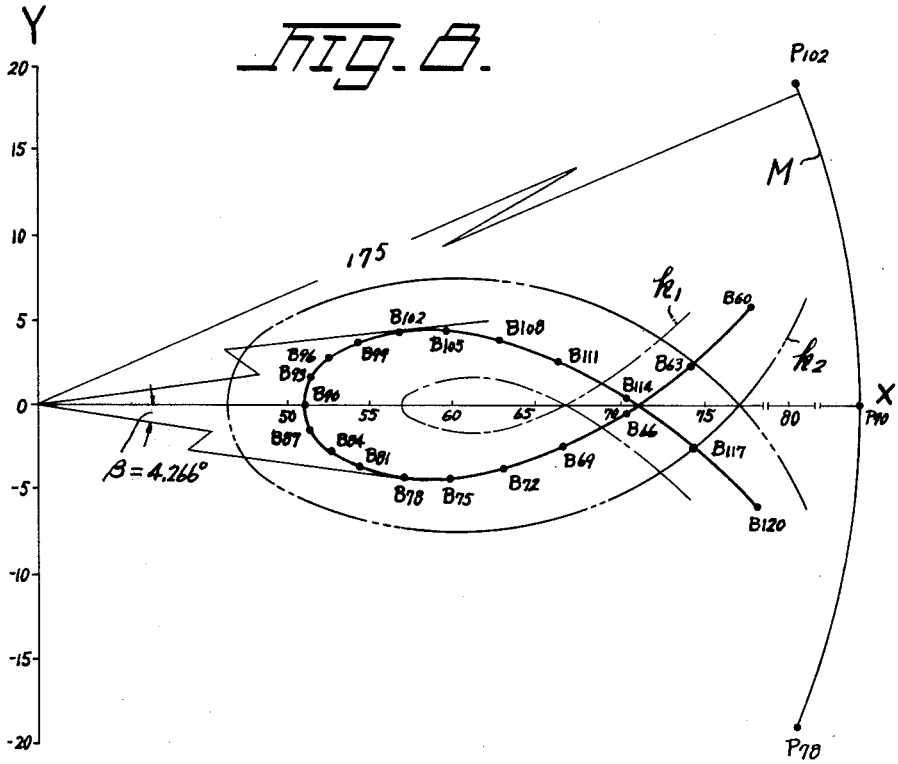
FIG. 8 is a fragmentary view on an enlarged scale of the H portion of the loci as shown in FIG. 5.

In order that the overall advance and return stroke movements of the feed bars 17 may be more clearly understood, reference will be had on FIGS. 5 and 8 in which the locus K described by the center B of the eccentric pin 9b as the pin moves in connection with the rotation of the crank of the press is shown and in these Figures, references $B_0$, $B_{10}$, $B_{20}$ . . . $B_{350}$ denote points on the locus K at which the center B of the eccentric pin 9b is positioned as the pin center moves in keeping with varying crank angles such as 0° (upper dead point), 10°,20° . . . 350° with each increment of 10°, for example as the press crank rotates. Reference $B_{78}$ shows the position of the pin center B at the crank angle 78°. Similarly, references $A_0$, $A_{10}$ . . . correspond to the crank angles of 0°, 10° . . . and show the points on the locus described by the center A of the planetary gear 10 at which the gear center A is positioned as the center moves in keeping with varying crank angles. References $P_0$, $P_{10}$ . . . also show points on the locus M described by the center P of the head 14a on the eccentric pin 14 as the head center moves in keeping with varying crank angles and show the positions of the head center at crank angles of 0°, 10°, . . . When the crank of the press has rotated by 60° and the actuator gear 7 also has rotated by the same angle, the center of the planetary gear 10 would have revolved about the sun gear 4 by 60° and thus, the center B of the eccentric pin 9b would have reached the point $B_6$ on the movement locus of the pin center B. Meantime, the disc 12 is also rotated by the movement of the roller 13 loosely fitted on the eccentric pin 9b and received in the radial groove 12a formed in the disc 12 whereby the center P of the head 14a of the eccentric pin 14 fitted in the disc 12 moves to the point $P_6$ on the locus M. And when the slider 16 fitted on the head 14a of the eccentric pin 14 moves within the elongated groove 15a formed in the slider 15 (the groove extends at right angles to the plane of FIG. 4), the slider 15 moves the feed bars 17 in the advance direction through the pin 18a of the slider 18 which is fitted in the elongated groove 15b formed in the slider 15 (the groove extends at right angles to the plane of FIG. 4). During the movement of the center B of the eccentric pin 9b from the point $B_{60}$ to the point $B_{78}$ on the locus K as the crank further continues to rotate, the center P of the eccentric pin head 14a also moves from the point $P_{60}$ to the point $P_{78}$ on the locus M to rotate the disc 12 by a small angular distance and at the same time, moves the feed bars by a short distance in the advance or return direction. The movement amount of by this short distance will be referred to as "a fine increment displacement amount of the feed bar" hereinafter and is shown by $\alpha$, for example. As the crank further continues to rotate to the crank angle of 90°, the center B of the eccentric pin 9b moves from the point $B_{78}$ to the point $B_{102}$, also the center P of the eccentric pin head 14a moves from the point $P_{78}$ to the point $P_{102}$ on the locus K and the disc 12 rotates with a small degree of oscillation to impart the feed bars 17 with the fine increment displacement movement as described hereinabove. Thereafter, as the crank further continues to rotate to the crank angle of 120°, the center B of the eccentric pin 9b moves from the point $B_{102}$ to the point $B_{120}$ on the locus K to rotate the disc by the same angular distance as that described hereinabove to thereby impart the feed bars with the fine increment displacement movement.

In the embodiment describd hereinabove, assuming that G = 120 mm, F = 60 mm and E = 39 mm, the coordinate values of the points $B_{60}$, $B_{63}$ and $B_{90}$ on the locus K described by the center B of the eccentric pin 9b along the X and Y axes in FIG. 8 and the tilt angles of the rectilinear lines which connect these points with the center C with respect to the X axis will be as shown in the following Table:

| | (O Point Origin) | B Point | |
|---|---|---|---|
| | X coordinate values | Y coordinate values (rotation angle of the disc) | |
| B | 51.000 | 0 | 0 ° |
| $B_{87}$ | 51.355 | −1.394 | −1.555 ° |
| $B_{84}$ | 52.414 | −2.647 | −2.891 ° |
| $B_{81}$ | 54.144 | −3.630 | −3.836 ° |
| $B_{78}$ | 56.478 | −4.213 | −4.266 ° |
| $B_{75}$ | 59.354 | −4.285 | −4.129 ° |
| $B_{72}$ | 62.676 | −3.742 | −3.417 ° |
| $B_{69}$ | 66.319 | −2.493 | −2.153 ° |
| $B_{66}$ | 70.164 | −0.488 | −0.398 ° |
| $B_{63}$ | 74.090 | +2.340 | 2.340 ° |
| $B_{60}$ | 77.940 | +6.000 | 4.402 ° |

As seen from the above Table, since the maximum angle $\beta$ for the fine increment rotation of the disc is 4.266° as shown in the above Table, the maximum value $\alpha$ for the fine increment displacement amount referred to hereinabove can be calculated by the following formula with the assumption that the feed stroke S is 350 mm:

$$\alpha = (S\text{mm}/2) \times (1 - \cos\beta) = 175 \times (1 - 0.00276) = 0.485 \text{ mm}$$

Thus, assuming that $\alpha/S$ is the fine increment displacement amount coefficient $\gamma$, then $\alpha/S = \gamma\gamma = 0.485/350 = 1/721 =$ constant.

And as seen from the realtion of $\alpha = \gamma S$, the fine increment displacement amount $\alpha$ varies in proportion to the feed stroke. On the other hand, when the mounting position of the eecentric pin 14a is changed, the feed stroke S can be varied accordingly. However, in the illustrated embodiment of the invention, since the value for the fine increment displacement amount $\alpha$of the feed bars is quite small, the successive increment feed operation of the press will not be impaired and in consequence, during the rotation of the crank from 0° to 60°, it may be said that the feed bars 17 remain stationary. Furthermore, according to the present invention, for the angular distance from 0° to 60°, an additional mechanism (not shown) allows the feed bars 17 to perform unclamping operation.

As the crank further continues to rotate from the crank angle of 60° until the center B of the eccentric pin 9*b* moves to the point $B_{120}$ on the locus K whereupon the device of the invention shifts to the return operation mode. Whent the crank rotates to the crank angle of 240°, the eccentric pin center B reaches the point $B_{240}$ on the locus K whereupon the device compeletes the return operation mode. Thereafter, as mentioned hereinabove, the disc 12 initiates the fine increment rotation mode and the feed bars 17 remain substantially stationary until the crank rotates to the crank angle of 300° and the eccentric pin center B reaches the point $B_{30}$ on the locus K and during the time period, the feed bars 17 perform the work clamping operation. Thereafter, as the crank continues to rotates, the feed bars 17 move in the advance direction (from left to right as seen in FIG. 4). By repeating the above movement operation cycle of the feed bars, the transfer press can continuously perform the advance and return movement.

In the ratio of G : F : E referred to hereinabove, E can be varied within the range of 35 – 43 and in FIG. 8, the curve $K_1$ shows the instance in which the ratio of G :F : E is 120 : 60 : 35 and $K_2$ shows the instance in which the ratio of G : F : E is 120 : 60 : 42, respectively.

With the above construction and arrangement of the parts of the device of the present invention, since the work transfer and drive device is mechanically driven in the advance and return strokes by the prime mover (not shown) through the intermediary shaft (not shown), the device can be driven in perfect synchronization with the operation of the transfer press. And the crank angle of 60° where the feed bars remain substantially stationary during the time interval between the advance and return strokes of the feed bars can be provided, the acceleration and deceleration of the feed bars can be made smooth and the device is compart with less number of parts and less expensive. Furthermore, according to the present invention, it is also possible that two opposed planetary gears are provided with the sun gear interposed therebetween and thus, the rotation torque of the disc can be increased to twofold. Furthermore, as compared with the conventional planetary gear system, the fine increment displacement of the feed bars in the device of the present invention is a quite small amount such as 1/721 of the fed bar stroke and in consequence, the fine increment displacement of the feed bars is that which substantially corresponds to their stationary state and ensures more stability.

While only one embodiment of the invention has been shown and described in detail it will be understood that the same is for illustration purpose only and not to be taken as a definition of the invention, reference being had for this purpose to the appended claims.

What is claimed is:

1. A work transfer and drive device in a transfer press comprising a stationary shaft supported in the framework of said press, an actuator gear rotatably supported on said stationary shaft to be driven by a prime mover through intermediary drive shaft of said press, a sun gear integrally mounted on said stationary shaft in coaxial relationship to said actuator gear, a planetary gear fixedly secured to an eccentric shaft on said actuator gear in meshing with said sun gear, an eccentric pin integral with said eccentric shaft, a rotary member rotatably mounted on said stationary shaft and having a radial groove formed therein for slidably receiving said eccentric pin, said rotary member having a second eccentric pin, a first slidable member guided by a stationary guide bar parallel to feed bars of said transfer press for operatively receiving said second eccentric pin and a second slidable member operatively connected to one of feed bars and to said first slidable member.

2. The device as set forth in claim 1, in which the base circle diameter of said sun gear, the base circle diameter of said planetary gear and the eccentricity amount of said eccentric pin of the planetary gear has the ratio of 120 : 60 : 35 ~ 42.

3. The device as set forth in claim 1, in which said eccentric pin on the rotary member of the stationary shaft is received in an elongated grove formed in said first slidable member at right angles to said feed bars and said second slidable member operatively connected to said one of the feed bars is slidably received in a second elongated groove formed in said first slidable member at right angles to said feed bars.

* * * * *